United States Patent [19]

Atkins

[11] 4,150,961

[45] Apr. 24, 1979

[54] AIR INTAKE ARRANGEMENT FOR INTERNAL COMBUSTION ENGINES

[76] Inventor: George Atkins, 68, Priory Ave., Bridgend, Mid Glamorgan, Wales

[21] Appl. No.: 794,055

[22] Filed: May 5, 1977

[30] Foreign Application Priority Data

Jan. 12, 1977 [GB] United Kingdom ..... 1192/77

[51] Int. Cl.[2] ..... F02M 35/00

[52] U.S. Cl. ..... 55/385 R; 55/209; 55/210; 261/64 B; 261/64 C

[58] Field of Search ..... 261/64 B, 64 C; 55/209, 55/210, 410, 510

[56] References Cited

U.S. PATENT DOCUMENTS

| | | | |
|---|---|---|---|
| 2,983,592 | 5/1961 | Jones | 55/510 |
| 3,426,508 | 2/1969 | McGrath | 55/210 |
| 3,722,186 | 3/1973 | Parker | 55/510 |
| 3,877,908 | 4/1975 | Phelps | 55/510 |

FOREIGN PATENT DOCUMENTS

| | | | |
|---|---|---|---|
| 674827 | 11/1963 | Canada | 55/510 |

*Primary Examiner*—Ronald H. Lazarus
*Attorney, Agent, or Firm*—Basile and Weintraub

[57] ABSTRACT

An air intake arrangement for internal combustion engines. The arrangement includes an intake passage and a filter assembly in which the volume between the filter element and the carburettor choke tube containing filtered air is variable such that upon a change in air pressure occurring in this region due to a particular engine operating condition, there is an immediate change in the volume containing the filtered air which maintains the air pressure therein constant.

9 Claims, 5 Drawing Figures

AIR INTAKE ARRANGEMENT FOR INTERNAL COMBUSTION ENGINES

The present invention relates to an air intake arrangement for internal combustion engines and is directed, more particularly, to effecting a pressure compensation in the intake passage between the air filter and carburettor.

The air-fuel requirements of an internal combustion engine under various operating conditions are well known, likewise the difficulty of maintaining such requirements due to variations in the humidity, temperature and inertia of the mixture flow, all of which render it virtually impossible to ensure a constant uniform pressure between the air intake and the entry to the carburettor choke tube, which condition is essential if the correct air-fuel mixture is to be maintained for any given operating condition.

In the past many attempts have been made to maintain the required air-fuel mixture ratio by means of pressure valves which enrichen or weaken the supply of petrol, but only marginal improvements have been achieved. Furthermore, compensation or correction of the mixture ratio or pressure has, in known arrangements, been effected between the carburettor choke tube and the engine inlet valves i.e. upstream of the main fuel nozzle opening into the choke tube, but this has been proved to be far from satisfactory.

Thus, the main object of the present invention is to provide an air intake arrangement for internal combustion engines which overcomes the difficulties and disadvantages referred to above.

The present invention consists in an air intake arrangement for internal combustion engines, the arrangement including an intake passage and a filter assembly in which the volume between the filter element and the carburettor choke tube containing filtered air is variable such that upon a change in air pressure occurring in this region due to a particular engine operating condition, there is an immediate change in said volume containing the filtered air which maintains the air pressure therein constant.

Figure 1:
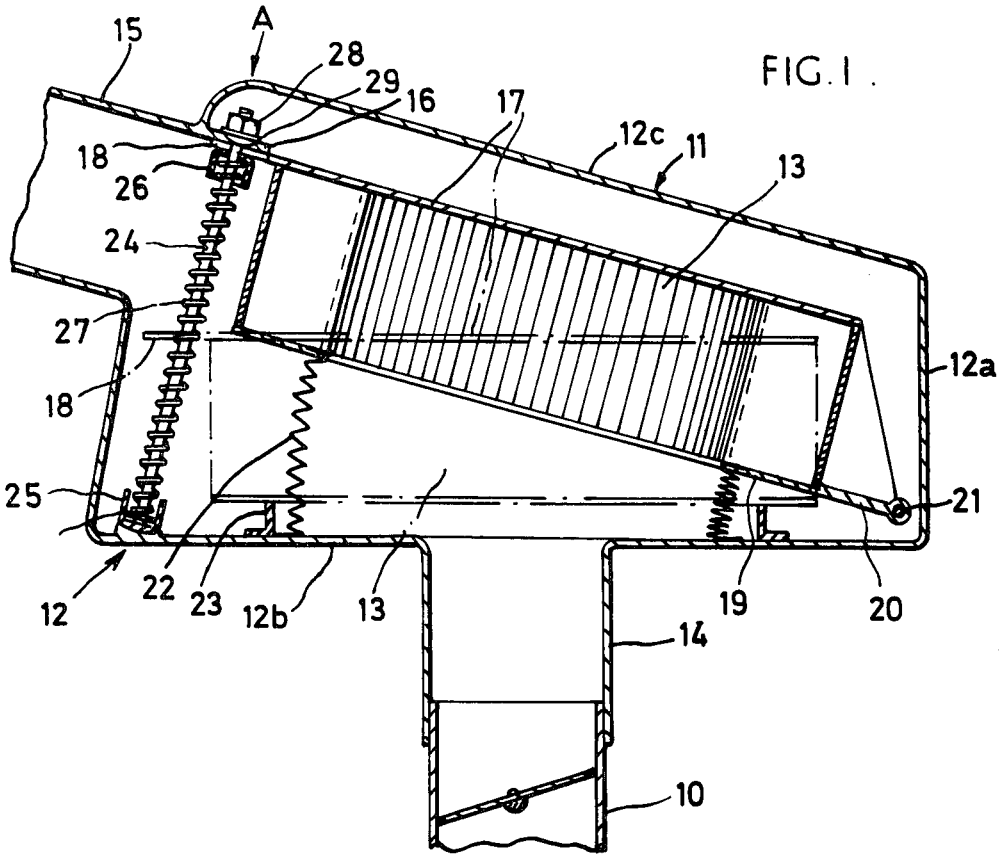
Figure 2:
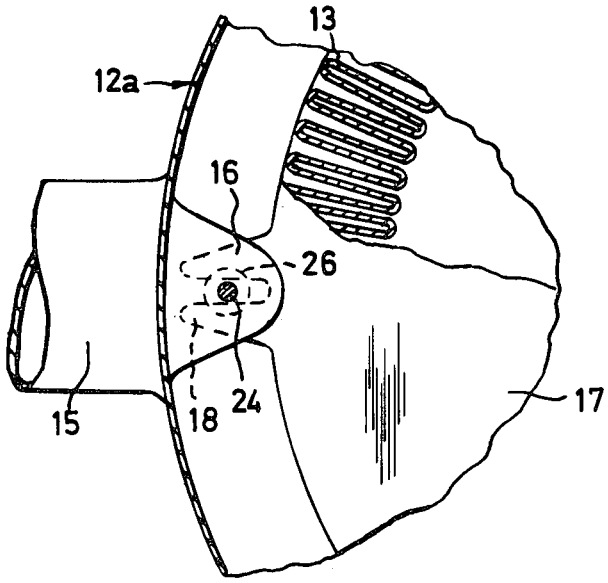
Figure 3:
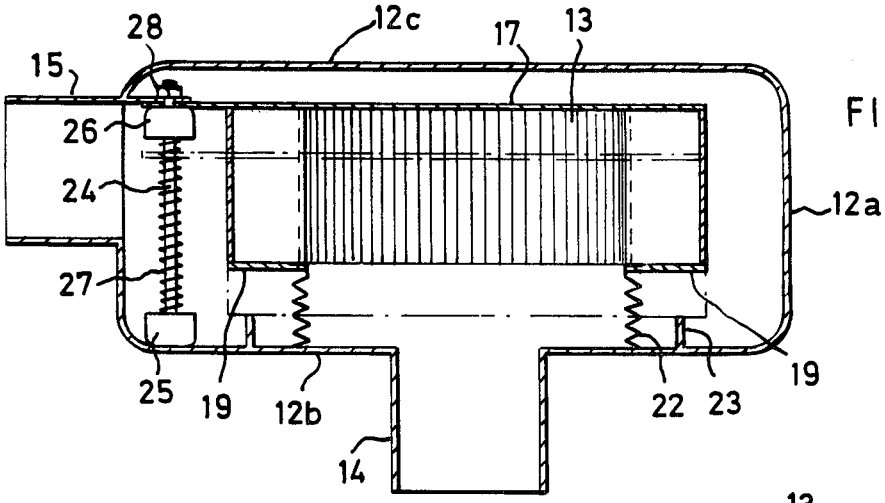
Figure 5:
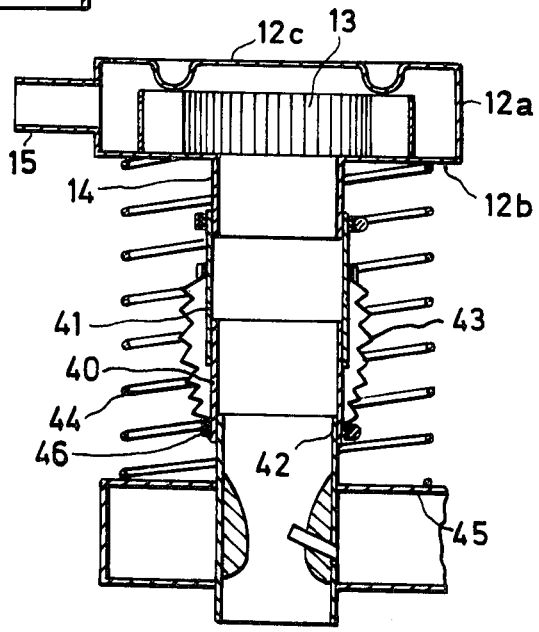
Figure 4:
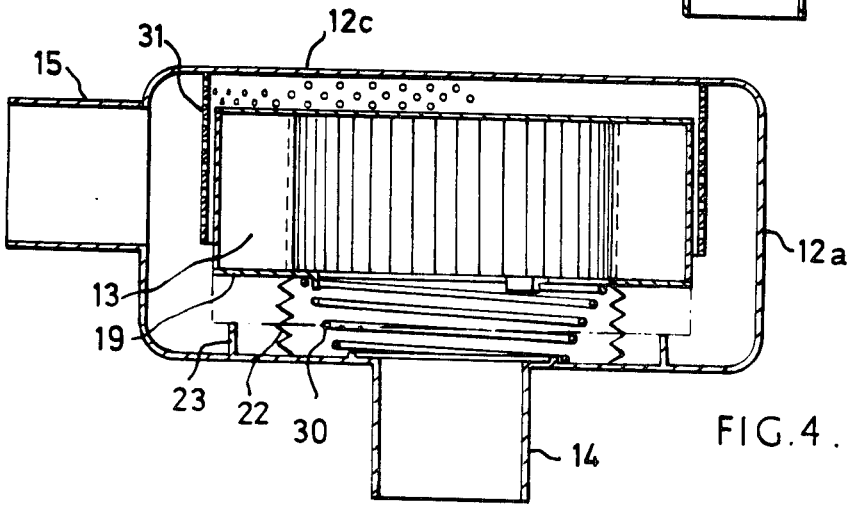

In the accompanying drawings:

FIG. 1 is a sectional view of an air filter assembly forming part of an air intake arrangement according to the present invention, FIG. 2 is a plan view taken in the direction of the arrow 'A' in FIG. 1 with members removed for clarity, FIGS. 3 and 4 are sectional views, similar to FIG. 1 of modified air filter assemblies, and FIG. 5 is a diagrammatic view of a further embodiment of the present invention.

In carrying the invention into effect according to one convenient mode, by way of example, the air intake arrangement includes an intake passage 10 and a filter assembly 11. The passage 10 communicates with the intake manifold of the engine (not shown), via a choke tube, fuel nozzle and throttle valve forming part of the usual carburettor, (also not shown) in known manner.

The end of the intake passage 10 remote from the carburettor has the air filter assembly 11 mounted thereon which comprises a casing 12 and a filter element 13 pivotally mounted therein. The casing 12 includes a cylindrical side wall **12*a*, a generally horizontal lower wall 12*b* which incorporates a removable cover and an angled upper wall 12*c*. The lower wall 12*b* has a downwardly depending air outlet tube 14 fixedly mounted on the extremity of intake passage 10 by a known type of clip (not shown) and the side wall 12*a* has an air inlet tube 15. An apertured abutment 16 (see FIG. 2) is provided on the casing side wall 12*a* adjacent the inlet tube 15** for a purpose hereinafter described.

The filter element 13 is of annular corrugated form made from felt, paper, or a synthetic plastics material through which air entering the inlet tube 15 must pass. The upper surface of the element 13 is sealed by a circular plate 17 having a bifurcated abutment 18 protruding outwardly from its periphery and the lower surface of the element 13 is supported by an annular plate 19 having an extension 20 positioned diametrically opposite the inlet tube 15 and which is pivotally mounted at 21 on the casing side wall **12*a***.

A tubular, circumferentially ridged diaphragm 22 has one end sealingly engaged around the inner periphery of the annular plate 19 and its other end sealingly engaged with the lower casing wall **12*b* around the outlet tube 14 so that air entering the inlet tube 15 can only pass to the outlet tube 14 via the filter element 13 and diaphragm 22. The casing lower wall 12*b* is provided with a plurality of upwardly extending stop members 23 which, in use, limit the downward pivotal movement of the filter element 13 to the position shown in dot-dash outline in FIG. 1**.

A rod 24, positioned adjacent the inlet tube 15 has its lower headed end housed in a cup mounting 25 and its upper screwthreaded end passing through a cup member 26, the slot in the bifurcated abutment 18 of the circular plate 17 and the aperture in the abutment 16 of the casing. A coil spring 27 is interposed between a washer **29*a* housed in the lower cup member 25 surrounding the rod 24 and the upper cup member 26, the spring 27 acting to urge the filter element 13 upwardly about the pivot 21. A nut 28 and washer 29 mounted on the upper end of the rod 24 engages the bifurcated abutment 16 to maintain the rod 24 in its correct position, the nut also acting as a spring adjustment means. Both the lower surface of the washer 29 and cup member 25 provide part-spherical seating surfaces which readily permit alignment of the rod 24 during pivotal movement of the filter element 13**.

Atmospheric pressure normally exists in the intake passage of an engine, but under certain conditions, acceleration for example which causes an increase in the velocity of the air flow, the filter element acts as an obstruction and causes a reduction in pressure which may be as great as 3 p.s.i. in the intake passage. However in the present arrangement, the pressure reduction immediately results in a downward pivotal movement of the filter element, resulting in a decrease in the effective volume of the intake passage which maintains the pressure in the passage constant so that the air-fuel mixture at the nozzle is not affected.

The modified arrangement shown in FIG. 3 is similar to that shown in FIG. 1 except that the filter element 13 is not pivotally mounted on the casing side wall **12*a* and the circular closure plate 17 is provided with three or more, equal spaced, apertured abutments 18 with a spring 27 and cup members 25, 26 interposed between the casing lower wall 12*b* and each abutment 18**.

As will be clearly seen from FIG. 3, variations in air pressure in the intake passage cause a rectilinear movement of the filter element 13 which achieves the same result as described above with reference to FIG. 1.

The further arrangement shown in FIG. 4 is similar to that shown in FIG. 3, except that the springs 27 and cup members 25, 26 are replaced by a single coil spring 30 interposed between the lower surface of the filter element 13 and the casing lower wall 12*b* coaxial with the outlet tube 14. A perforated metal cylinder 31, fixed to the upper wall 12*c*, surrounds the filter element 13 to ensure the required rectilinear movement thereof.

In a further embodiment shown in FIG. 5, the intake passage 10 is formed by two concentric tubes, 40, 41 telescoped one within the other, and fixed, respectively, to the carburettor intake 42 and the outlet 14 of an air filter assembly of known type. The outer surface of the tube 40 and the inner surface of the tube 41 are coated with a known self-lubricating metal and the tubes are sealed against the manifold depression by means of a bellows member 43. A compression spring 44 is interposed between the carburettor body 45 and the lower wall 12*b* of the filter casing so that the volume of the intake passage is maximum. Suitable abutments 46 limit the movement of the tubes 40, 41.

In a modified arrangement (not shown), the telescoped concentric tubes 40, 41 are maintained in a central position by oppositely acting compression springs. With this arrangement, in the event of the air pressure rising in the intake passage 10, for example, under a full throttle, hard pulling condition of the engine, the concentric tubes 40, 41 are urged apart causing an increase in the volume of the intake passage 10 which maintains the air pressure constant. It will be readily appreciated that a similar arrangement can be utilized with the other embodiment described above.

I claim:

1. An internal-combustion engine including an air intake arrangement, said arrangement comprising a carburetor choke tube; an intake passage upstream from said tube; a casing between said tube and said passage; a filter element mounted in said casing, the filter element and the intake passage upstream of the carburetor choke tube defining a volume containing filtered air which is variable such that, upon a change in air pressure occurring in this region due to a particular engine operating condition, there is an immediate change in said volume containing the filtered air which maintains the air pressure therein constant, said change in volume being effected by the filter element being movable in the casing, and means sealing said element against the ingress of air except through its filtration surface.

2. An internal-combustion engine having an air intake arrangement as claimed in claim 1, wherein said filter element is pivotally mounted in the casing for movement between a pair of spaced abutment means, there being a resilient means urging said element at least in a direction to increase the volume containing the filtered air.

3. An internal-combustion engine having an air intake arrangement as claimed in claim 2, wherein a tubular diaphragm has one end sealingly engaged around the air outlet of the filter casing and its other end sealingly engaged with said carburetor chock tube.

4. An internal-combustion engine having an air intake arrangement as claimed in claim 1, wherein said filter element is mounted for rectilinear movement in its casing between said spaced abutment means, there being resilient means urging said element at least in a direction to increase the volume containing the filtered air.

5. An internal-combustion engine having an air intake arrangement as claimed in claim 4, wherein a tubular diaphragm has one end sealingly engaged around the air outlet of the filter casing and its other end sealingly engaged with said carburetor chock tube.

6. An internal-combustion engine having an air intake arrangement as claimed in claim 2, wherein one surface of said filter element is sealed by a closure plate having an abutment protruding outwardly from its periphery opposite said pivot mounting, said resilient means comprising a spring interposed between said abutment and a wall of said casing.

7. An internal-combustion engine having an air intake arrangement as claimed in claim 4, wherein one surface of said filter element is sealed by a closure plate having a plurality of abutments protruding outwardly around its periphery, said resilient means comprising a spring interposed between each abutment and a wall of said casing.

8. An internal-combustion engine having an air intake arrangement as claimed in claim 4, wherein one surface of said filter element is sealed by a closure plate and said resilient means comprises a spring interposed between another surface of said element and a wall of said casing.

9. An internal-combustion engine having an air intake arrangement as claimed in claim 1, wherein said change in volume is effected by the intake passage being formed by two concentric tubes telescoped for sliding movement one within the other, there being provided means for sealing the interengaging portions of the tubes and resilient means urging said tubes at least in a direction to increase the volume containing the filtered air.

* * * * *